US008888444B2

(12) United States Patent
Hernandez Sanchez et al.

(10) Patent No.: US 8,888,444 B2
(45) Date of Patent: Nov. 18, 2014

(54) STEAM SEAL SYSTEM

(75) Inventors: Nestor Hernandez Sanchez, Schenectady, NY (US); Kamlesh Mundra, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 601 days.

(21) Appl. No.: 13/108,272

(22) Filed: May 16, 2011

(65) Prior Publication Data

US 2012/0294707 A1 Nov. 22, 2012

(51) Int. Cl.

*F04D 29/08* (2006.01)
*F01D 11/06* (2006.01)
*F01D 11/10* (2006.01)

(52) U.S. Cl.

CPC ..... *F01D 11/10* (2013.01); *F05B 2240/40* (2013.01); *F01D 11/06* (2013.01)
USPC ..... 415/145; 415/112; 277/431

(58) Field of Classification Search

CPC ..... F01D 11/06; F01D 11/10
USPC ..... 415/111, 112, 145, 174.5, 230; 277/411, 412, 418, 431, 432
See application file for complete search history.

(56) References Cited

U.S. PATENT DOCUMENTS

| | | | | | |
|---|---|---|---|---|---|
| 1,757,212 | A | * | 5/1930 | Parsons et al. | 277/419 |
| 3,604,206 | A | | 9/1971 | Baily | |
| 3,906,730 | A | * | 9/1975 | Bellati et al. | 60/657 |
| 4,290,609 | A | | 9/1981 | Dumont | |
| 5,344,160 | A | | 9/1994 | Scarlata et al. | |
| 5,454,689 | A | * | 10/1995 | Falavigna | 415/112 |
| 5,632,492 | A | * | 5/1997 | Lehmann et al. | 277/409 |
| 5,941,506 | A | | 8/1999 | Smith et al. | |

FOREIGN PATENT DOCUMENTS

| | | | | | |
|---|---|---|---|---|---|
| CN | 2670606 | Y | | 1/2005 | |
| CN | 201301730 | Y | | 9/2009 | |
| JP | 54047012 | A | * | 4/1979 | F01D 11/04 |

* cited by examiner

*Primary Examiner* — Ned Landrum
*Assistant Examiner* — Alexander White
(74) *Attorney, Agent, or Firm* — Hoffman Warnick LLC.; Ernest G. Cusick

(57) ABSTRACT

A steam seal system is disclosed. In one embodiment, the steam seal system includes: a low pressure steam turbine positioned on a shaft; a pair of end packings surrounding the shaft, each of the pair of end packings located proximate an axial end of the low pressure steam turbine along the shaft; and an pair of extraction conduits fluidly connected to the low pressure steam turbine and the shaft, the pair of extraction conduits connected to the shaft at a location axially outward of the pair of end packings and the low pressure steam turbine.

18 Claims, 1 Drawing Sheet

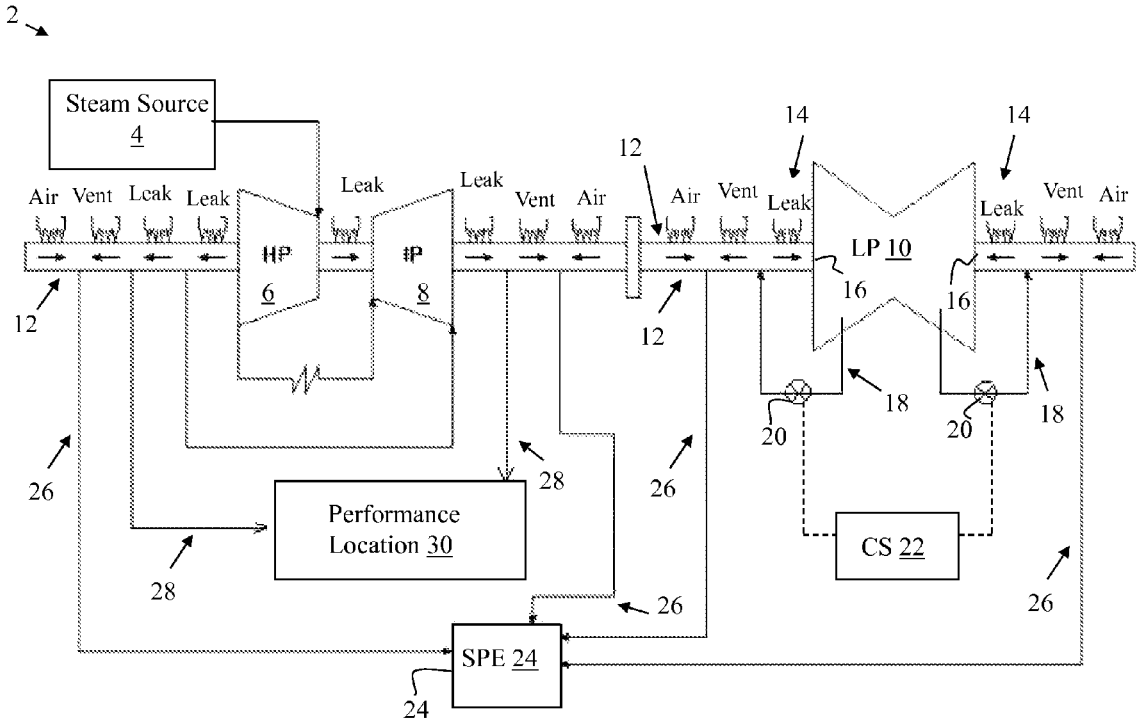
2
Steam Source
4
Air
Vent
Leak
Leak
HP
6
Leak
Leak
IP
8
Vent
Air
12
Air
Vent
Leak
14
LP 10
16
Leak
Vent
Air
14
16
12
12
18
20
20
18
26
28
26
Performance
Location 30
CS 22
28
26
26
SPE 24
24

STEAM SEAL SYSTEM

BACKGROUND OF THE INVENTION

The subject matter disclosed herein relates to a steam seal system for a steam turbine configuration. Specifically, the subject matter disclosed herein relates to a single header steam seal system for a steam turbine configuration.

Steam seal systems and end packings are conventionally used in turbine operations (e.g., steam turbine operations) to seal portions of a shaft near the interface between that shaft and the turbine's casing. The end packings are usually divided into two groups: pressure packings and vacuum packings. Without the steam seal system, the pressure packings would leak steam outwardly from inside the turbine casing (e.g., into the turbine room), while the vacuum packings would leak air from the atmosphere into the turbine casing. The conventional steam seal system attempts to solve these problems by utilizing the steam leaking from the pressure packings to seal the vacuum packings.

The conventional sealing steam is maintained at a constant pressure (slightly higher than atmospheric, e.g., 4 pounds per square inch gauge (psig)) by a steam seal regulator in a steam seal header (SSH). In order to prevent the pressure packings from allowing leakage of steam into the turbine room (from within the turbine casing), a steam packing exhauster (SPE) is used to extract steam from an outermost ring at each packing, creating a slight (e.g., −0.2 psig) vacuum.

Conventionally, the SSH and SPE pressures remain constant throughout all load conditions of the turbine system, including, e.g., low loads, transient loads, etc. In times of low load, where the extracted steam mass flow may be insufficient to form an effective seal, additional steam may be supplied from an external source (e.g., an auxiliary boiler).

Unfortunately, the conventional steam sealing system requires that end packings (e.g., those endpackings at a high pressure (HP) or intermediate pressure (IP) turbine) are designed for sealing purposes, and not performance. Additionally, the conventional steam sealing system uses high-pressure and intermediate-pressure steam from the HP and IP turbines, respectively, to provide sealing steam for the LP turbine. This can require that the higher-pressure (and correspondingly, high temperature) steam be cooled before it is introduced to the LP end packings. Further, the use of this extraction steam from the HP and IP turbines for sealing the LP turbine end packings causes a loss of efficiency, as the higher-energy steam from those HP and IP turbines could be more effectively used in driving a portion of the turbine system.

BRIEF DESCRIPTION OF THE INVENTION

A steam seal system is disclosed. In one embodiment, the steam seal system includes: a low pressure steam turbine positioned on a shaft; a pair of end packings surrounding the shaft, each of the pair of end packings located proximate an axial end of the low pressure steam turbine along the shaft; and an pair of extraction conduits fluidly connected to the low pressure steam turbine and the shaft, the pair of extraction conduits connected to the shaft at a location axially outward of the pair of end packings and the low pressure steam turbine.

A first aspect of the invention includes a steam seal system having: a low pressure steam turbine positioned on a shaft; a pair of end packings surrounding the shaft, each of the pair of end packings located proximate an axial end of the low pressure steam turbine along the shaft; and a pair of extraction conduits fluidly connected to the low pressure steam turbine and the shaft, the pair of extraction conduits connected to the shaft at a location axially outward of the pair of end packings and the low pressure steam turbine.

A second aspect of the invention includes a steam seal system having: a steam turbine positioned on a shaft; a pair of end packings surrounding the shaft, each of the pair of end packings located proximate an axial end of the steam turbine along the shaft; a pair of extraction conduits fluidly connected to the steam turbine and the shaft, the pair of extraction conduits connected to the shaft at a location axially outward of the pair of end packings and the steam turbine; and a first valve and a second valve respectively located along each of the pair of extraction conduits.

A third aspect of the invention includes a steam seal system having: a steam turbine positioned on a shaft; a pair of end packings surrounding the shaft, each of the pair of end packings located proximate an axial end of the steam turbine along the shaft; a pair of extraction conduits fluidly connected to the steam turbine and the shaft, the pair of extraction conduits connected to the shaft at a location axially outward of the pair of end packings and the steam turbine; a first valve and a second valve respectively located along each of the pair of extraction conduits; and a control system operably connected to the first valve and the second valve, the control system configured to actuate at least one of the first valve or the second valve to control an amount of steam extracted from the steam turbine and admitted to the shaft.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which:

FIG. 1 shows a schematic diagram of a turbine system, including a steam seal system, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a seal system for a steam turbine system. Specifically, the subject matter disclosed herein relates to a single header steam seal system for a steam turbine.

As described herein, the conventional steam sealing system requires that the end packings (e.g., those endpackings at a high pressure (HP) or intermediate pressure (IP) turbine) are designed for sealing purposes, and not performance. Additionally, the conventional steam sealing system uses high-pressure and intermediate-pressure steam from the HP and IP turbines, respectively, to provide sealing steam for the low pressure (LP) turbine. This can require that the higher-pressure (and correspondingly, high temperature) steam be cooled before it is introduced to the LP end packings. Further, the use of this extraction steam from the HP and IP turbines in sealing the LP turbine causes a loss of efficiency, as the higher-energy steam from those HP and IP turbines could be more effectively used in driving a portion of the turbine system.

In contrast to the conventional steam sealing systems, aspects of the invention provide for a steam seal system that eliminates the need for a steam seal header (SSH), and uses an active control system along with a steam packing exhauster (SPE) to regulate sealing of steam along turbine shafts.

In one aspect of the invention, a steam seal system is disclosed having: a low pressure steam turbine positioned on a shaft; a pair of end packings surrounding the shaft, each of the pair of end packings located proximate an axial end of the low pressure steam turbine along the shaft; and a pair of extraction conduits fluidly connected to the low pressure steam turbine and the shaft, the pair of extraction conduits connected to the shaft at a location axially outward of the pair of end packings and the low pressure steam turbine.

Turning to FIG. 1, a turbine system 2 is shown including a steam source 4 (e.g., a heat recovery steam generator, boiler, etc.) which provides high-pressure steam to a conventional high pressure (HP) steam turbine 6. Also shown is a conventional intermediate pressure (IP) steam turbine 8, fluidly connected to the HP steam turbine 6 via a conventional conduit (numbering omitted). Additionally, the turbine system may include a low pressure (LP) steam turbine 10, which is depicted in this example as a double-flow LP steam turbine. It is understood, however, that the LP steam turbine may take other conventional forms not depicted herein (e.g., an axial flow steam turbine, or a multiple flow LP steam turbine). Also shown in turbine system 2 is a shaft 12, on which at least one of the HP steam turbine 6, IP steam turbine 8 and LP steam turbine 10 may be positioned. It is understood that the shaft 12 depicted herein may in actuality include a series of shafts coupled using one or more conventional coupling elements, as is known in the art. As is known in the art, the steam turbines may be individually or collectively coupled to a driven machine (e.g., an electrical generator for the purpose of generating electricity, or any other type of mechanically driven machine such as a compressor or pump). Additionally, the flow of fluid (e.g., steam) across the surface of shaft 12 is indicated by arrows pointing either axially upstream, downstream or sideways.

Turbine system 2 may further include a pair of end packings 14 surrounding the shaft 12, where each of the pair of end packings is located proximate to an axial end 16 of the LP steam turbine 10 along the shaft 12. It is further understood that a plurality of packings (or, packing rings) may be used to seal portions of the shaft 12 (e.g., where different packings are indicated by "air", "leak" or "vent" terms). In any case, the end packings 14 may be used to substantially seal these axial ends 16 of the LP steam turbine 10 (e.g., at the casing/shaft interface) to prevent ambient air from entering the steam flow path. However, in contrast to conventional steam seal systems, these end packings 14 may be fluidly connected to an extraction conduit of the LP steam turbine 10, allowing the steam seal system disclosed herein to provide low energy steam to the end packings 14 for sealing the LP steam turbine 10. That is, the turbine system 2 shown in FIG. 1 may further include a pair of extraction conduits 18 fluidly connected to the LP steam turbine 10 and the shaft 12. These extraction conduits 18 may be connected to the shaft 12 at a location axially outward of the pair of end packings 14 and the LP steam turbine 10. More specifically, the extraction conduits provide extracted low pressure steam from the LP steam turbine 10 to an axially outward portion of the end packings 14, where that low pressure steam may act as sealing steam to the end packings 14. In one embodiment, the low pressure steam may be extracted from LP steam turbine 10 at a relatively higher-pressure stage of the turbine such that it covers the intended ST operating envelope, e.g., a L4 or L3 stage (of stages L0-L4 or L0-L5) of the LP steam turbine 10. It is understood that these stage numberings refer to each side of a double-flow LP steam turbine (as in LP steam turbine 10), and in the case of an axial flow steam turbine, these stage numberings may vary. As shown in FIG. 1, the pair of extraction conduits 18 are fluidly isolated from seal systems for the IP steam turbine 8 and the HP steam turbine 6.

In any case, the extraction conduits 18 may each include a valve (e.g., a first valve and a second valve) 20 respectively located along the extraction conduit 18, where each valve 20 is configured to limit a flow of fluid (e.g., steam) through each extraction conduit 18. Also shown is a control system (CS) 22, which is operably connected to the first valve 20 and the second valve 20, where the control system 22 is configured to control the flow of steam through one or both valves 20 by actuating movement of the valves 20. It is understood that valves 20 and control system 22 may be any combination of conventional valves and control systems, including mechanical, electrical, electro-mechanical, wireless, etc. systems configured to dictate the amount of steam extracted from the LP steam turbine 10 and provided as sealing fluid to the end packings 14. In one embodiment, the control system 22 may include an active monitoring and/or actuation system that actuates movement of the valves 20 (e.g., via conventional commands) in response to a turbine parameter. For example, the control system 22 may monitor the load on LP steam turbine 10 and determine that the amount of steam extracted from the LP steam turbine 10 and admitted to the end packings 14 should be modified in order to provide an effective seal at the end packings 14. In another embodiment, the control system 22 may monitor a load of another turbine (e.g., HP steam turbine 6 and/or IP steam turbine 8), a flow rate through one or more conduits (some numbering omitted), and/or a power output of one or more turbines (e.g., via an associated generator power output, generator omitted for clarity).

Also shown included in the turbine system 2 of FIG. 1 is a steam packing exhauster (SPE) 24 and a plurality of SPE extraction conduits 26 fluidly connected to the SPE 24 and the shaft 12. The SPE extraction conduits 26 may be fluidly connected to the shaft 12 at locations axially outward of one of the pair of extraction conduits 18, such that the SPE extraction conduits 26 are farther from the LP steam turbine 10 along the shaft than the extraction conduits 18. Aspects of the invention may further provide for a performance extraction conduit 28 configured to provide steam from a portion of the shaft 12 axially outward of the HP steam turbine 6 or the IP steam turbine 8 to a "performance location" 30 in the turbine system 2. In one embodiment, the "performance location" may be at least one of: an intermediate HP or IP stage, an HP turbine exhaust location, an IP turbine exhaust location, or any other location that results in increased overall turbine system 2 efficiency based upon the design of the turbine system 2. Because the performance location 30 will be determined as part of the steam turbine design, it will not necessarily be controlled by the control system 22.

In any case, in contrast to conventional turbine systems (which utilize a steam seal header (SSH) and corresponding conduits similarly positioned as the performance extraction conduits 28), the turbine systems (e.g., turbine system 2 and its variations) disclosed herein allow for extraction of high pressure and/or low pressure steam (e.g., via performance extraction conduits 28) and provide that high pressure and/or low pressure steam to a location in the system that will enhance overall performance (e.g., system efficiency, output, response time, etc.). Further, aspects of the invention allow for the reduction in hardware required to effectively seal a steam system, by, e.g., eliminating the steam seal header (SSH) and atemperation systems of the prior art, thereby reducing the costs associated with sealing a steam turbine system.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam seal system comprising:

a low pressure steam turbine positioned on a shaft;

an intermediate pressure steam turbine positioned on the shaft;

a high pressure steam turbine positioned on the shaft;

a pair of end packings surrounding the shaft, each of the pair of end packings located proximate an axial end of the low pressure steam turbine along the shaft; and a pair of extraction conduits fluidly connected to the low pressure steam turbine and the shaft, the pair of extraction conduits connected to the shaft at a location axially outward of the pair of end packings and the low pressure steam turbine, wherein the pair of extraction conduits provide a flow of only low pressure steam extracted from the low pressure steam turbine to the pair of end packings, wherein the pair of extraction conduits are fluidly isolated from seal systems for the intermediate pressure steam turbine and the high pressure steam turbine.

2. The steam seal system of claim 1, further comprising a first valve and a second valve respectively located along each of the pair of extraction conduits.

3. The steam seal system of claim 2, further comprising a control system operably connected to the first valve and the second valve, the control system configured to control the flow of only the low pressure steam through at least one of the first valve or the second valve.

4. The steam seal system of claim 1, further comprising:

a steam packing exhauster (SPE); and a SPE extraction conduit fluidly connected to the SPE, and the shaft at a location axially outward of one of the pair of extraction conduits.

5. The steam seal system of claim 1, wherein the pair of extraction conduits are fluidly connected to the low pressure steam turbine proximate to a L4 or L3 stage of the low pressure steam turbine.

6. The steam seal system of claim 5, wherein the pair of extraction conduits provide low pressure steam from the L4 or L3 stage to the shaft proximate the pair of end packings.

7. The steam seal system of claim 1, wherein all of the low pressure steam extracted from the low pressure steam turbine is provided to the pair of end packings to seal the low pressure steam turbine.

8. A steam seal system comprising:

a low pressure steam turbine positioned on a shaft;

an intermediate pressure steam turbine positioned on the shaft;

a high pressure steam turbine positioned on the shaft;

a pair of end packings surrounding the shaft, each of the pair of end packings located proximate an axial end of the low pressure steam turbine along the shaft;

a pair of extraction conduits fluidly connected to the low pressure steam turbine and the shaft, the pair of extraction conduits connected to the shaft at a location axially outward of the pair of end packings and the low pressure steam turbine, wherein the pair of extraction conduits provide a flow of only low pressure steam extracted from the low pressure steam turbine to the pair of end packings, wherein the pair of extraction conduits are fluidly isolated from seal systems for the intermediate pressure steam turbine and the high pressure steam turbine, wherein the pair of extraction conduits are fluidly connected to the low pressure steam turbine proximate to a L4 or L3 stage of the low pressure steam turbine; and a first valve and a second valve respectively located along each of the pair of extraction conduits.

9. The steam seal system of claim 8, further comprising a control system operably connected to the first valve and the second valve, the control system configured to control the flow of only the low pressure steam through at least one of the first valve or the second valve.

10. The steam seal system of claim 8, further comprising:

a steam packing exhauster (SPE); and a SPE extraction conduit fluidly connected to the SPE, and the shaft at a location axially outward of one of the pair of extraction conduits.

11. The steam seal system of claim 8, wherein the pair of extraction conduits provide the low pressure steam from the L4 or L3 stage to the shaft proximate the pair of end packings.

12. The steam seal system of claim 8, wherein all of the low pressure steam extracted from the low pressure steam turbine is provided to the pair of end packings to seal the low pressure steam turbine.

13. A steam seal system comprising:

a low pressure steam turbine positioned on a shaft;

an intermediate pressure steam turbine positioned on the shaft;

a high pressure steam turbine positioned on the shaft;

a pair of end packings surrounding the shaft, each of the pair of end packings located proximate an axial end of the low pressure steam turbine along the shaft;

a pair of extraction conduits fluidly connected to the low pressure steam turbine and the shaft, the pair of extraction conduits connected to the shaft at a location axially outward of the pair of end packings and the low pressure steam turbine, wherein the pair of extraction conduits provide a flow of only low pressure steam extracted from the low pressure steam turbine to the pair of end packings, wherein the pair of extraction conduits are fluidly isolated from seal systems for the intermediate pressure steam turbine and the high pressure steam turbine;

a first valve and a second valve respectively located along each of the pair of extraction conduits; and a control system operably connected to the first valve and the second valve, the control system configured to monitor an operating parameter of the low pressure steam turbine, and actuate at least one of the first valve or the second valve to control an amount of steam extracted from the low pressure steam turbine and admitted to the shaft based upon the operating parameter.

14. The steam seal system of claim 13, further comprising:

a steam packing exhauster (SPE); and a plurality of SPE extraction conduits fluidly connected to the SPE, and the shaft at a location axially outward of the pair of extraction conduits.

15. The steam seal system of claim 14, further comprising a performance extraction conduit configured to provide steam from a portion of the shaft axially outward of the HP steam turbine or the IP steam turbine to one of: an HP stage or IP stage, an HP turbine exhaust location, or an IP turbine exhaust location.

16. The steam seal system of claim 13, wherein the pair of extraction conduits are fluidly connected to the low pressure steam turbine proximate to a L4 or L3 stage of the low pressure steam turbine.

17. The steam seal system of claim 16, wherein the pair of extraction conduits provide steam from the L4 or L3 stage to the shaft proximate the pair of end packings.

18. The steam seal system of claim 13, wherein all of the low pressure steam extracted from the low pressure steam turbine is provided to the pair of end packings to seal the low pressure steam turbine.

* * * * *